US010654067B2

(12) United States Patent
Ho et al.

(10) Patent No.: US 10,654,067 B2
(45) Date of Patent: May 19, 2020

(54) DRIVING DEVICE OF CAULKING GUN

(71) Applicant: Ping-Tzu Ho, Taichung (TW)

(72) Inventors: Ping-Tzu Ho, Taichung (TW); I-Pei Ho, Taichung (TW)

(73) Assignee: Ping-Tzu Ho, Taichung (TW)

( * ) Notice: Subject to any disclaimer, the term of this patent is extended or adjusted under 35 U.S.C. 154(b) by 0 days.

(21) Appl. No.: 16/299,720

(22) Filed: Mar. 12, 2019

(65) Prior Publication Data

US 2019/0314856 A1 Oct. 17, 2019

(30) Foreign Application Priority Data

Apr. 11, 2018 (TW) ..... 107112370 A

(51) Int. Cl.
*B05C 17/01* (2006.01)

(52) U.S. Cl.
CPC ..... *B05C 17/0103* (2013.01); *B05C 17/012* (2013.01)

(58) Field of Classification Search
CPC ..... B05C 17/0103; B05C 17/012
USPC ..... 222/390
See application file for complete search history.

(56) References Cited

U.S. PATENT DOCUMENTS 3,208,638 A * 9/1965 Frenzel ..... B05C 17/0103 222/39
RE26,180 E * 4/1967 Frenzel et al. ..... B05C 17/01 222/39
4,180,187 A * 12/1979 Ben-Haim ..... B05C 17/0103 192/141
4,260,076 A * 4/1981 Bergman ..... B05C 17/0103 222/327
4,322,022 A * 3/1982 Bergman ..... B05C 17/0103 222/327
5,027,984 A * 7/1991 Gakhar ..... B05C 17/0103 222/326
5,203,476 A * 4/1993 Keller ..... B05C 17/00553 222/136
5,219,099 A * 6/1993 Spence ..... A61M 5/1456 222/325
5,556,009 A * 9/1996 Motzko ..... B05B 12/085 192/125 A (Continued)

FOREIGN PATENT DOCUMENTS

TW I551031 B 9/2016

*Primary Examiner* — Patrick M. Buechner
*Assistant Examiner* — Michael J. Melaragno
(74) *Attorney, Agent, or Firm* — Muncy, Geissler, Olds & Lowe, PC

(57) ABSTRACT

A driving device of caulking gun includes a housing, a driving assembly, a threaded rod, and a transmission assembly. The housing defines an axial direction. The driving assembly is disposed on the housing and includes a motor assembly and a driving gear. The motor assembly and the driving gear are linked-up to rotate simultaneously. The threaded rod is slidably disposed on the housing and is nonrotatable with respect to the housing. The threaded rod is formed with a spiral groove. The transmission assembly is arranged in the housing and includes a transmission sleeve and a plurality of abutting members. The transmission sleeve is sleeved onto the threaded rod and is radially formed with a plurality of through holes. The abutting members are received in the through holes respectively. The transmission sleeve and the driving gear are linked-up.

13 Claims, 5 Drawing Sheets

(56) References Cited

U.S. PATENT DOCUMENTS 5,762,239 A * 6/1998 Cossette ..... B05C 17/00553 222/326
5,871,299 A * 2/1999 Lai ..... B05C 17/0103 222/327
6,273,302 B1 * 8/2001 Fornaro ..... B05C 17/0103 222/333
6,488,180 B1 * 12/2002 Bayat ..... B05C 17/00553 222/137
6,745,921 B2 * 6/2004 Beckett ..... B05C 17/01 222/327
6,926,177 B1 * 8/2005 Scott ..... B05C 17/00516 222/326
7,192,267 B2 * 3/2007 Glucksman ..... A21C 11/18 222/326
7,637,392 B2 * 12/2009 Hsu ..... B05C 17/0103 222/137
7,703,643 B2 * 4/2010 Wang ..... B05C 17/0133 222/1
7,854,348 B2 * 12/2010 Wang ..... G01F 11/026 222/326
7,883,033 B2 * 2/2011 Lind ..... B05B 5/0255 222/390
8,701,938 B2 * 4/2014 Darian ..... A21C 15/005 222/132
8,998,039 B2 * 4/2015 Kimura ..... B65D 83/0033 222/327
2007/0068973 A1 * 3/2007 Herman ..... B05C 17/00576 222/386
2008/0073381 A1 * 3/2008 Wang ..... B05C 17/00589 222/333
2008/0221530 A1 * 9/2008 Glejbol ..... A61M 5/31551 604/211
2009/0039113 A1 * 2/2009 Hsu ..... B05C 17/0103 222/333
2009/0071986 A1 * 3/2009 Wang ..... G01F 11/026 222/333
2009/0101673 A1 * 4/2009 Alioto ..... B05C 17/00553 222/113
2012/0097704 A1 * 4/2012 Johnson ..... F41B 9/0037 222/79
2012/0118917 A1 * 5/2012 Naughton ..... G01F 11/00 222/333
2013/0020350 A1 * 1/2013 Gardos ..... A01M 3/00 222/1
2014/0312074 A1 * 10/2014 Madsen ..... A61M 5/20 604/211
2017/0290583 A1 * 10/2017 Reed ..... A61B 17/07207
2017/0290587 A1 * 10/2017 Schober ..... A61B 17/07207

* cited by examiner

DRIVING DEVICE OF CAULKING GUN

BACKGROUND OF THE INVENTION

Field of the Invention

The present invention relates to a driving device of caulking gun.

Description of the Prior Art

A caulking gun is widely used to fill the cracks. The conventional caulking gun has a pressing assembly and a pushing rod. The pressing assembly can drive the pushing rod to slide by pressing the pressing assembly to push the glue out. However, it is laborious. Thus, an electrical caulking gun is provided. The rolling ball threaded rod is driven to slide by the motor in order to push the glue out, as shown in patent TW 1551031. After use, the threaded rod has to be pulled back to the original position to remove the empty glue tube. Generally, the threaded rod is pulled back by the motor rotates reversely.

However, the motor is driven to rotate reversely by the circuit system, so it takes time to pull the threaded rod back. In addition, the circuit system costs too much and damages often.

SUMMARY OF THE INVENTION

The main object of the present invention is to provide a driving device of caulking gun which is able to push the glue out smoothly by the threaded rod driven by the motor. In addition, the driving device has a clutch device to slide the threaded rod back and forth so as to detach or install the glue tube quickly.

To achieve the above and other objects, the driving device of caulking gun of the present invention includes a housing, a driving assembly, a threaded rod, a transmission assembly, and a clutch device.

The housing defines an axial direction. The driving assembly is disposed on the housing and includes a motor assembly and a driving gear. The motor assembly and the driving gear are linked-up to rotate simultaneously. The threaded rod is slidably disposed on the housing and is nonrotatable with respect to the housing. The threaded rod is formed with a spiral groove. The transmission assembly is arranged in the housing and includes a transmission sleeve and a plurality of abutting members. The transmission sleeve is sleeved onto the threaded rod and is radially formed with a plurality of through holes. The abutting members is received in the through holes respectively. The transmission sleeve and the driving gear are linked-up. The clutch device includes a restriction assembly and a braking member. The restriction assembly is sleeved onto the transmission sleeve. The braking member is movable with respect to the housing between a first position and a second position. When the braking member is located at the first position, the braking member radially abuts against the restriction assembly, and the restriction assembly pushes the abutting members to make the abutting members abut against the spiral groove so that the threaded rod is irremovable with respect to the transmission sleeve along the axial direction. When the braking member is located at the second position, the restriction assembly is not abutted against by the braking member, and the abutting members are free from restriction by the restriction assembly so that the abutting members are able to leave the spiral groove and that the threaded rod is slidable with respect to the transmission sleeve along the axial direction. The braking member is sleeved onto the transmission sleeve and is slidable with respect to the transmission sleeve along the axial direction. The braking member includes a circumferential wall. When the braking member is located at the first position, the circumferential wall is sleeved onto the restriction assembly. When the braking member moves toward the second position, the braking member moves away from the restriction assembly, and the circumferential wall leaves the restriction assembly.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
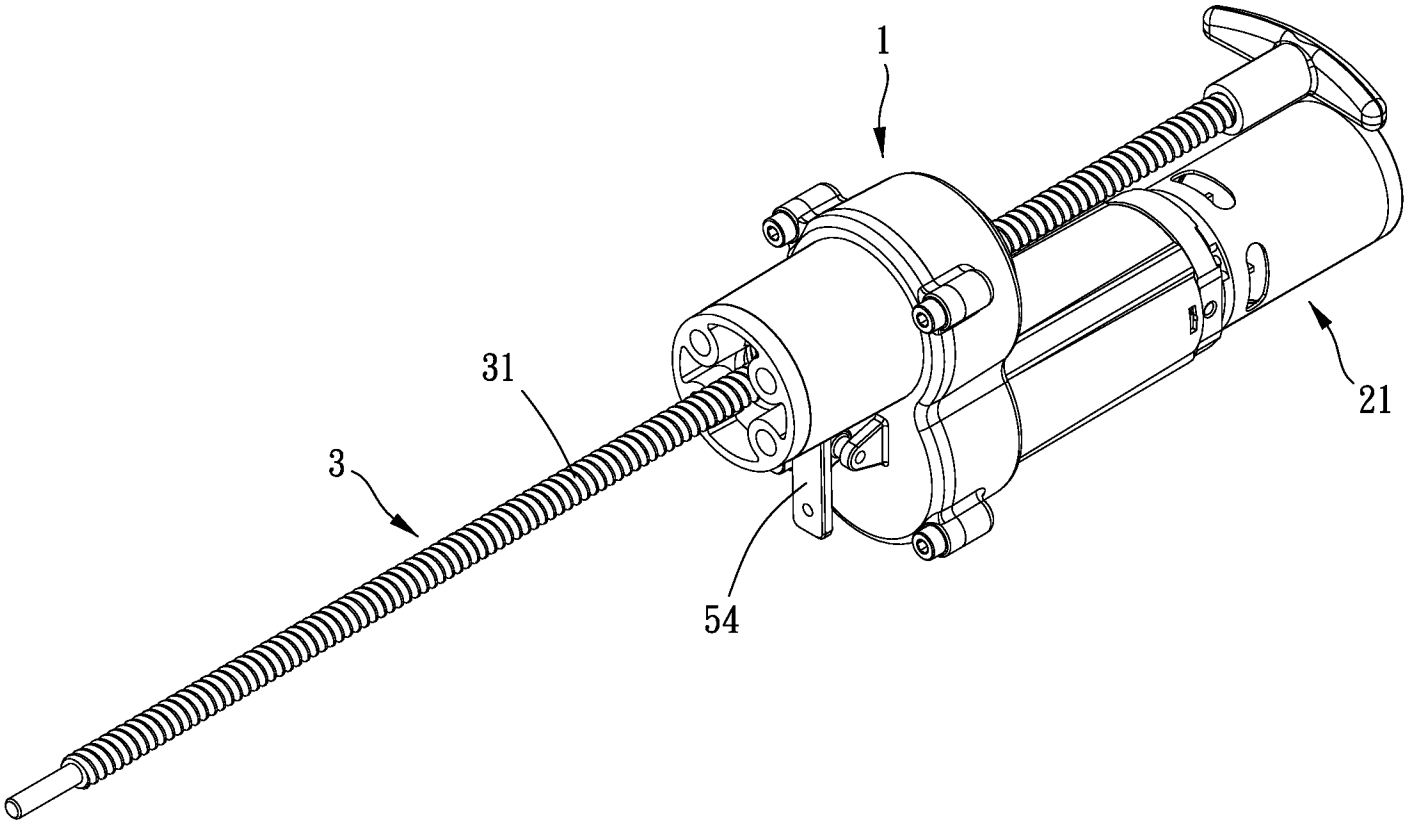
FIG. 1 is a stereogram of the present invention.
Figure 2:
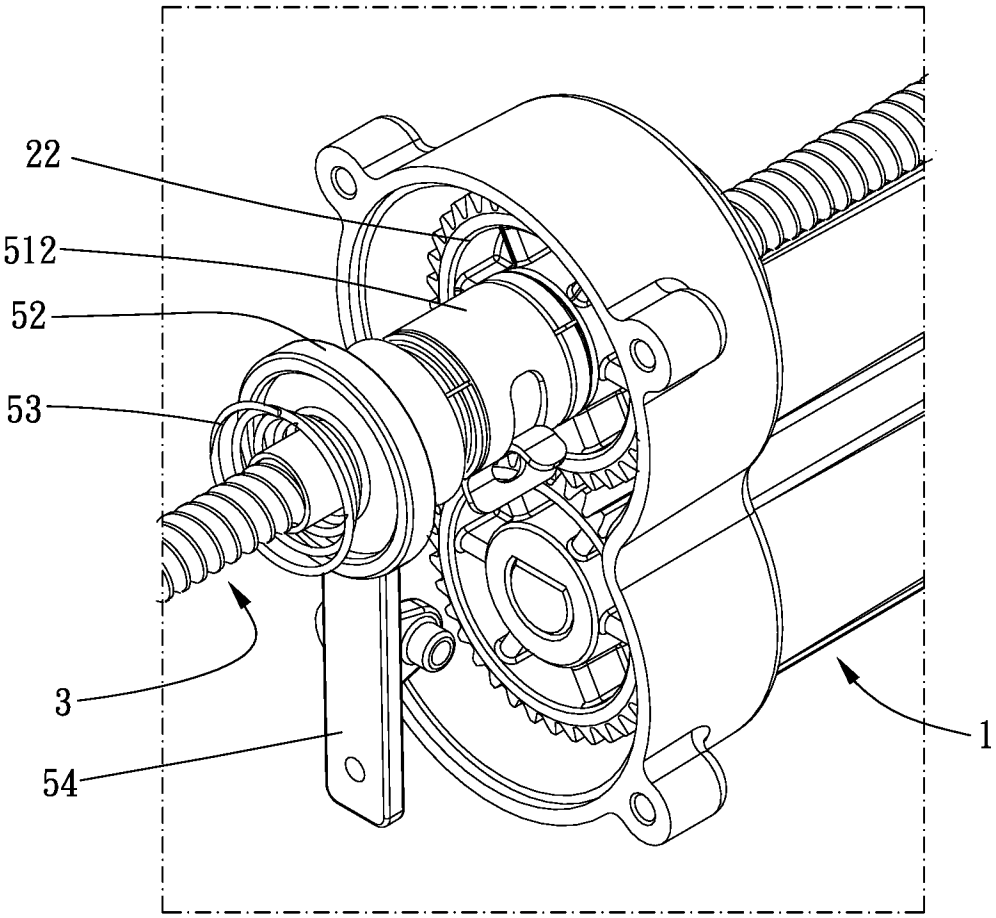
FIG. 2 is a partial enlargement of the present invention.
Figure 3:
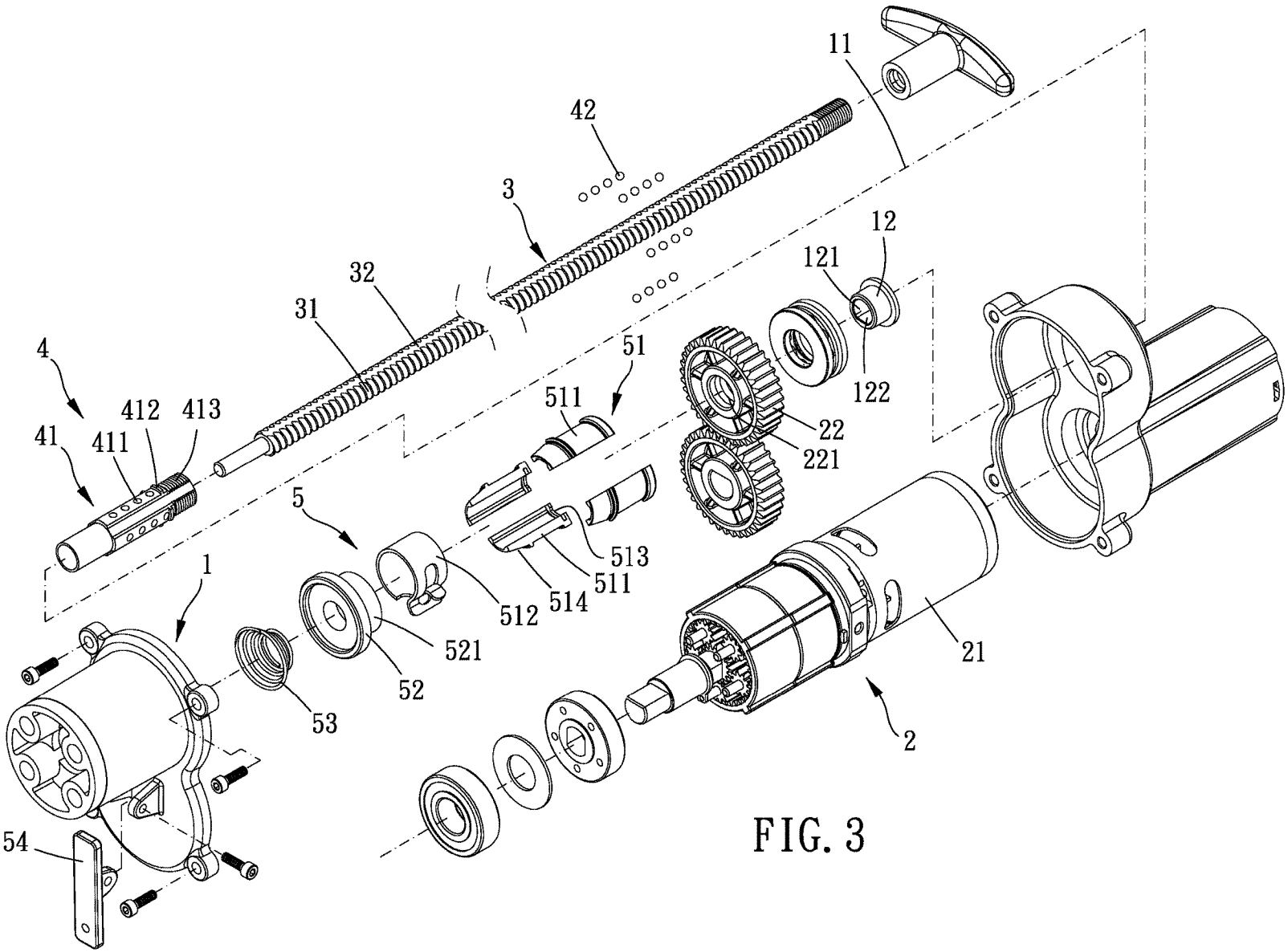
FIG. 3 is a breakdown drawing of the present invention.

Please refer to FIG. 1 to FIG. 5, the driving device of caulking gun of the present invention includes a housing 1, a driving assembly 2, a threaded rod 3, a transmission assembly 4, and a clutch device 5.

The housing 1 defines an axial direction 11.

The driving assembly 2 is disposed on the housing 1 and includes a motor assembly 21 and a driving gear 22. The motor assembly 21 and the driving gear 22 are linked-up to rotate simultaneously.

The threaded rod 3 is slidably disposed on the housing 1 and is nonrotatable with respect to the housing 1. The threaded rod 3 is formed with a spiral groove 31. In the present embodiment, the housing 1 has a rotation-preventing member 12. The rotation-preventing member 12 has an insertion hole 121. The insertion hole 121 has a flat section 122. The threaded rod 3 is inserted through the insertion hole 121 and has a recess section 32 corresponding to the flat section 122. Thereby, the threaded rod 3 is nonrotatable with respect to the housing 1.

The transmission assembly 4 is arranged in the housing 1 and includes a transmission sleeve 41 and a plurality of abutting members 42. The transmission sleeve 41 is sleeved onto the threaded rod 3 and is radially formed with a plurality of through holes 411. The abutting members 42 is received in the through holes 411 respectively. The transmission sleeve 41 and the driving gear 22 are linked-up. When the motor assembly 21 drives the driving gear 22 to rotate, the driving gear 22 drives the transmission sleeve 41 to rotate. In the present embodiment, each of the abutting members 42 is a rolling ball. Each of the abutting members 42 is slidably arranged in the through hole 411.

The clutch device 5 includes a restriction assembly 51 and a braking member 52. The restriction assembly 51 is sleeved onto the transmission sleeve 41. The braking member 52 is movable with respect to the housing 1 between a first position and a second position. In the present embodiment, the transmission sleeve 41 has an outer thread section 413 at an end thereof remote from the braking member 52, and the driving gear 22 has an inner thread section 221. The driving gear 22 is sleeved onto the transmission sleeve 41, and the inner thread section 221 is screwed with the outer thread section 413 so that the driving gear 22 is able to drive the transmission sleeve 41 to rotate. Thereby, the driving gear 22 and the transmission sleeve 41 are prevented from sliding with respect to each other.

When the braking member 52 is located at the first position, the braking member 52 radially abuts against the restriction assembly 51, and the restriction assembly 51 pushes the abutting members 42 to make the abutting members 42 abut against the spiral groove 31 so that the threaded rod 3 is irremovable with respect to the transmission sleeve 41 along the axial direction 11. When the transmission sleeve 41 is driven to rotate by the driving gear 22, the abutting members 42 in the through holes 411 drive the threaded rod 3 to slide along the axial direction 11 with respect to the housing 1 because the threaded rod 3 is nonrotatable with respect to the housing 1. When the braking member 52 is located at the second position, the restriction assembly 51 is not abutted against by the braking member 52, and the abutting members 42 are free from restriction by the restriction assembly 51 so that the abutting members 42 are able to leave the spiral groove 31. When the user holds the threaded rod 3 to slide the threaded rod 3, the abutting members 42 are pushed by the spiral groove 31 to jump out radially outward. Thereby, the threaded rod 3 is slidable with respect to the transmission sleeve 41 along the axial direction 11 in order to quickly detach or install the glue tube.

Figure 4:
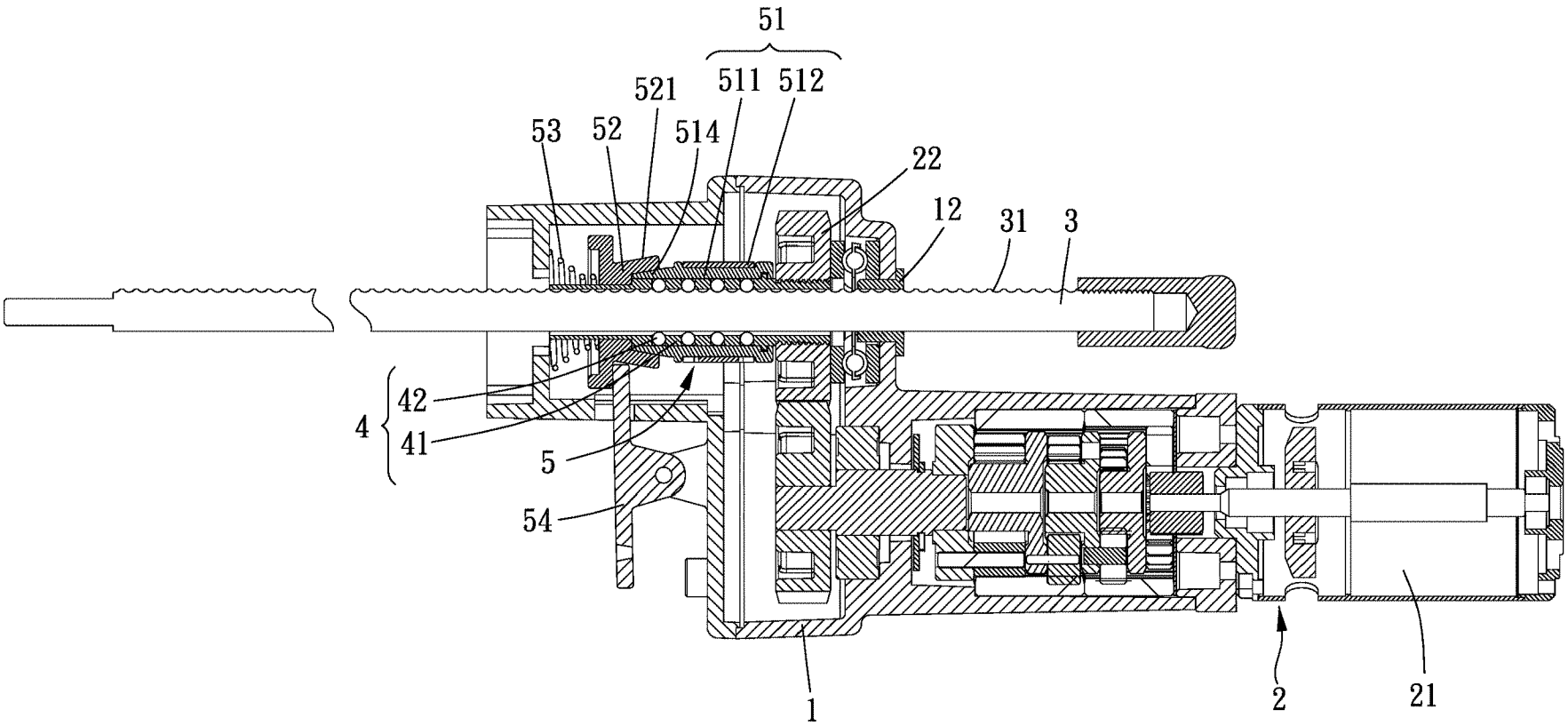
FIG. 4 and FIG. 5 are illustration of operation of the present invention.
Figure 5:
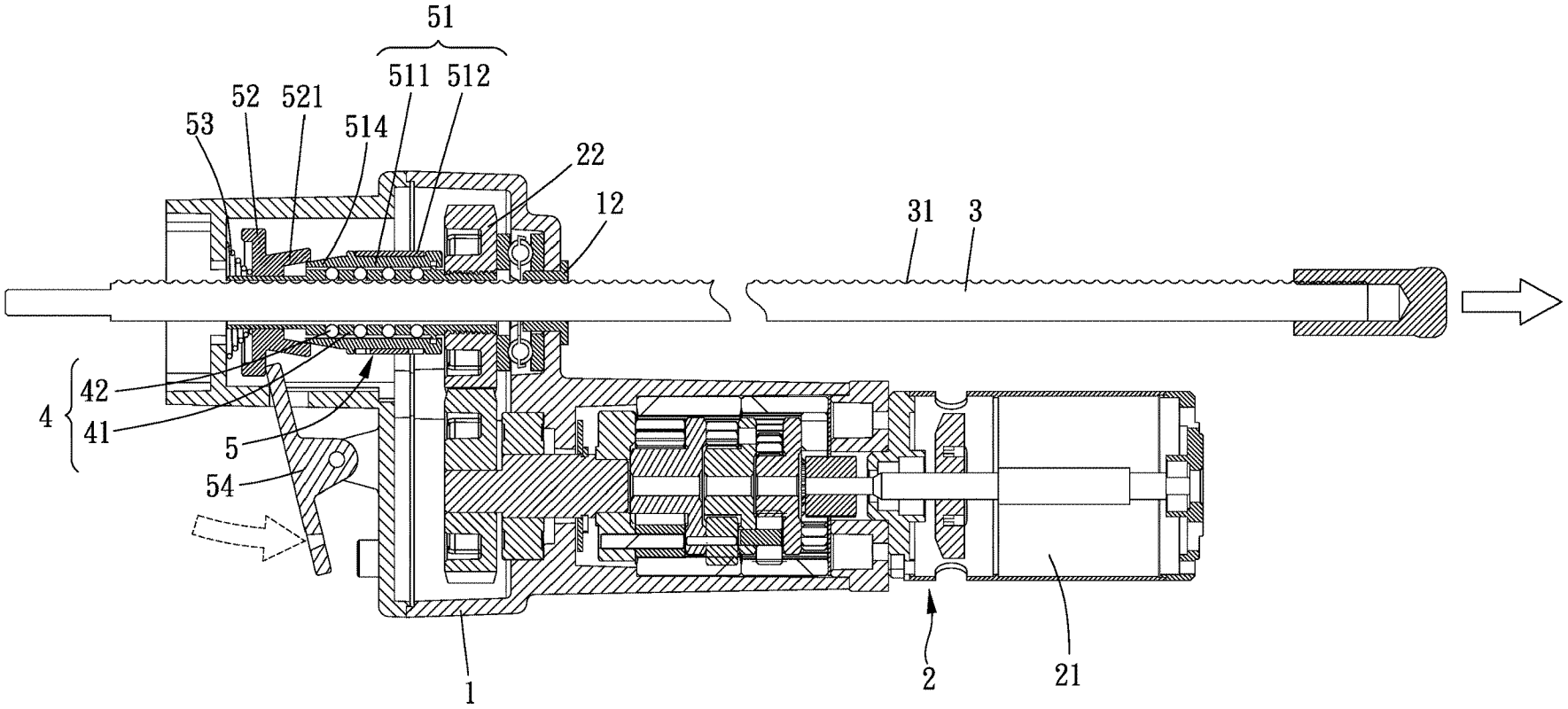

Specifically, the braking member 52 is sleeved onto the transmission sleeve 41 and is slidable with respect to the transmission sleeve 41 along the axial direction 11. The braking member 52 includes a circumferential wall 521. When the braking member 52 is located at the first position, as shown in FIG. 4, the circumferential wall 521 is sleeved onto the restriction assembly 51. Thereby, the restriction assembly 51 is unable to swing radially outward, and the restriction assembly 51 abuts against the abutting members 42 toward the spiral groove 31. When the braking member 52 moves toward the second position, as shown in FIG. 5, the braking member 52 moves away from the restriction assembly 51, and the circumferential wall 521 leaves the restriction assembly 51. Thereby, the restriction assembly 51 is not restricted by the circumferential wall 51 to be swingable radially outward.

More specifically, the restriction assembly 51 includes at least two clamping plates 511 and an elastic buckle member 512. The at least two clamping plates 511 enclose a column-shape space therebetween. The elastic buckle member 512 is sleeved onto the at least two clamping plates 511 to make the at least two clamping plates 511 tend to abut toward the transmission sleeve 41 radially. In the present embodiment, the restriction assembly 51 includes four said clamping plates 511 independent from each other. When the braking member 52 is located at the first position, the circumferential wall 521 is sleeved onto the clamping plates 511 so that the clamping plates 511 are unable to swing radially outward. When the braking member 52 is located the second position, the at least two clamping plates 511 are released from the circumferential wall 521. When the threaded rod 3 is to slide, the abutting members 42 are pushed by the spiral groove 31 to jump out radially outward. Thereby, the abutting members 42 push the clamping plates 511 radially outward to be released from the elastic buckle member 512. Therefore, the elastic buckle member 512 deforms, so the abutting members 42 can leave the spiral groove 31 so that the threaded rod 3 can slide smoothly with respect to the transmission sleeve 41 along the axial direction 11. In other possible embodiments, the clamping plates can be connected with each other with an end to be sleeve-shaped. The other end of each of the clamping plates is a free end.

Preferably, transmission sleeve 41 is formed with at least flange 412 along a circumferential direction thereof. Each of the clamping plates 511 is formed with a notch 513. The flanges 412 are embedded in the notches 513 respectively so that the each of the clamping plates 511 is irremovable with respect to the transmission sleeve 41 along the axial direction 11. Thereby, the clamping plates 511 is prevented from being driven to slide when the threaded rod 3 slides with respect to the housing 1. In other possible embodiments, the notches and the flanges can be arranged reversely.

In the present embodiment, the circumferential wall 521 expands toward the restriction assembly 51. The restriction assembly 51 has a tapering section 514 at an end thereof facing the circumferential wall 521. When the braking member 52 is located at the first position, the circumferential wall 521 is sleeved onto the tapering section 514. Thereby, the terminal face of the circumferential wall 521 and the terminal face of the tapering section 514 are prevented from abutting against each other.

Specifically, in the present embodiment, the clutch device 5 further includes an elastic member 53 and a toggle bar 54. The elastic member 53 is biased between the housing 1 and the braking member 52 so that the braking member 52 tends to move toward the first position. The toggle bar 54 is pivotally disposed on the housing 1. An end of the toggle bar 54 abuts against the braking member 52. The braking member 52 is moved toward the second position when an end of the toggle bar 54 remote from the braking member 52 is pressed. Thereby, the user can just press the toggle bar 54 with one hand to move the braking member 52 to the second position, and hold the threaded rod 3 with the other hand to slide the threaded rod 3.

In conclusion, when the braking member is located at the second position, the braking member doesn't abut against the restriction assembly radially, so the abutting members are not restricted by the restriction assembly to be able to selectively leave the spiral groove. When the user holds the threaded rod to slide the threaded rod, the abutting members are pushed by the spiral groove to jump out radially outward. Thereby, the threaded rod can slide with respect to the transmission sleeve along the axial direction for quickly installing or detaching the glue tube.

What is claimed is:

1. A driving device of caulking gun including:

a housing, defining an axial direction;

a driving assembly, disposed on the housing, including a motor assembly and a driving gear, the motor assembly and the driving gear being linked-up to rotate simultaneously;

a threaded rod, slidably disposed on the housing and being nonrotatable with respect to the housing, the threaded rod being formed with a spiral groove;

a transmission assembly, arranged in the housing, including a transmission sleeve and a plurality of abutting members, the transmission sleeve being sleeved onto the threaded rod and being radially formed with a plurality of through holes, the abutting members being received in the through holes respectively, the transmission sleeve and the driving gear being linked-up;

a clutch device, including a restriction assembly and a braking member, the restriction assembly being sleeved onto the transmission sleeve, the braking member being movable with respect to the housing between a first position and a second position;

wherein when the braking member is located at the first position, the braking member radially abuts against the restriction assembly, the restriction assembly pushes the abutting members to make the abutting members abut against the spiral groove so that the threaded rod is irremovable with respect to the transmission sleeve along the axial direction; when the braking member is located at the second position, the restriction assembly is not abutted against by the braking member, the abutting members are free from restriction by the restriction assembly so that the abutting members are able to leave the spiral groove and that the threaded rod is slidable with respect to the transmission sleeve along the axial direction;

wherein the braking member is sleeved onto the transmission sleeve and is slidable with respect to the transmission sleeve along the axial direction, the braking member includes a circumferential wall; when the braking member is located at the first position, the circumferential wall is sleeved onto the restriction assembly; when the braking member moves toward the second position, the braking member moves away from the restriction assembly, the circumferential wall leaves the restriction assembly;

wherein the restriction assembly includes at least two clamping plates and an elastic buckle member, the at least two clamping plates enclose a column-shape space therebetween, the elastic buckle member is sleeved onto the at least two clamping plates to make the at least two clamping plates tend to abut toward the transmission sleeve radially; when the braking member is located at the first position, the circumferential wall is sleeved onto the at least two clamping plates; when the braking member is located the second position, the at least two clamping plates are released from the circumferential wall.

2. The driving device of caulking gun of claim 1, wherein transmission sleeve is formed with at least flange along a circumferential direction thereof, each of the clamping plates is formed with a notch, the flanges are embedded in the notches respectively so that the each of the clamping plates is irremovable with respect to the transmission sleeve along the axial direction.

3. A driving device of caulking gun including:

a housing, defining an axial direction;

a driving assembly, disposed on the housing, including a motor assembly and a driving gear, the motor assembly and the driving gear being linked-up to rotate simultaneously;

a threaded rod, slidably disposed on the housing and being nonrotatable with respect to the housing, the threaded rod being formed with a spiral groove;

a transmission assembly, arranged in the housing, including a transmission sleeve and a plurality of abutting members, the transmission sleeve being sleeved onto the threaded rod and being radially formed with a plurality of through holes, the abutting members being received in the through holes respectively, the transmission sleeve and the driving gear being linked-up;

a clutch device, including a restriction assembly and a braking member, the restriction assembly being sleeved onto the transmission sleeve, the braking member being movable with respect to the housing between a first position and a second position;

wherein when the braking member is located at the first position, the braking member radially abuts against the restriction assembly, the restriction assembly pushes the abutting members to make the abutting members abut against the spiral groove so that the threaded rod is irremovable with respect to the transmission sleeve along the axial direction; when the braking member is located at the second position, the restriction assembly is not abutted against by the braking member, the abutting members are free from restriction by the restriction assembly so that the abutting members are able to leave the spiral groove and that the threaded rod is slidable with respect to the transmission sleeve along the axial direction;

wherein the braking member is sleeved onto the transmission sleeve and is slidable with respect to the transmission sleeve along the axial direction, the braking member includes a circumferential wall; when the braking member is located at the first position, the circumferential wall is sleeved onto the restriction assembly; when the braking member moves toward the second position, the braking member moves away from the restriction assembly, the circumferential wall leaves the restriction assembly;

wherein the circumferential wall expands toward the restriction assembly, the restriction assembly has a tapering section at an end thereof facing the circumferential wall, when the braking member is located at the first position, the circumferential wall is sleeved onto the tapering section.

4. A driving device of caulking gun including:

a housing, defining an axial direction;

a driving assembly, disposed on the housing, including a motor assembly and a driving gear, the motor assembly and the driving gear being linked-up to rotate simultaneously;

a threaded rod, slidably disposed on the housing and being nonrotatable with respect to the housing, the threaded rod being formed with a spiral groove;

a transmission assembly, arranged in the housing, including a transmission sleeve and a plurality of abutting members, the transmission sleeve being sleeved onto the threaded rod and being radially formed with a plurality of through holes, the abutting members being received in the through holes respectively, the transmission sleeve and the driving gear being linked-up;

a clutch device, including a restriction assembly and a braking member, the restriction assembly being sleeved onto the transmission sleeve, the braking member being movable with respect to the housing between a first position and a second position;

wherein when the braking member is located at the first position, the braking member radially abuts against the restriction assembly, the restriction assembly pushes the abutting members to make the abutting members abut against the spiral groove so that the threaded rod is irremovable with respect to the transmission sleeve along the axial direction; when the braking member is located at the second position, the restriction assembly is not abutted against by the braking member, the abutting members are free from restriction by the restriction assembly so that the abutting members are able to leave the spiral groove and that the threaded rod is slidable with respect to the transmission sleeve along the axial direction;

wherein the braking member is sleeved onto the transmission sleeve and is slidable with respect to the transmission sleeve along the axial direction, the braking member includes a circumferential wall; when the braking member is located at the first position, the circumferential wall is sleeved onto the restriction assembly; when the braking member moves toward the second position, the braking member moves away from the restriction assembly, the circumferential wall leaves the restriction assembly;

wherein the clutch device further includes an elastic member and a toggle bar, the elastic member is biased between the housing and the braking member so that the braking member tends to move toward the first position, the toggle bar is pivotally disposed on the housing, an end of the toggle bar abuts against the braking member, the braking member is moved toward the second position when an end of the toggle bar remote from the braking member is pressed.

5. The driving device of caulking gun of claim 1, wherein each of the abutting members is a rolling ball, each of the abutting members is slidably arranged in the through hole.

6. The driving device of caulking gun of claim 1, wherein the transmission sleeve has an outer thread section at an end thereof remote from the braking member, the driving gear has an inner thread section, the driving gear is sleeved onto the transmission sleeve, the inner thread section is screwed with the outer thread section.

7. The driving device of caulking gun of claim 1, wherein the housing has a rotation-preventing member, the rotation-preventing member has an insertion hole, the insertion hole has a flat section, the threaded rod is inserted through the insertion hole and has a recess section corresponding to the flat section.

8. The driving device of caulking gun of claim 3, wherein each of the abutting members is a rolling ball, each of the abutting members is slidably arranged in the through hole.

9. The driving device of caulking gun of claim 3, wherein the transmission sleeve has an outer thread section at an end thereof remote from the braking member, the driving gear has an inner thread section, the driving gear is sleeved onto the transmission sleeve, the inner thread section is screwed with the outer thread section.

10. The driving device of caulking gun of claim 3, wherein the housing has a rotation-preventing member, the rotation-preventing member has an insertion hole, the insertion hole has a flat section, the threaded rod is inserted through the insertion hole and has a recess section corresponding to the flat section.

11. The driving device of caulking gun of claim 4, wherein each of the abutting members is a rolling ball, each of the abutting members is slidably arranged in the through hole.

12. The driving device of caulking gun of claim 4, wherein the transmission sleeve has an outer thread section at an end thereof remote from the braking member, the driving gear has an inner thread section, the driving gear is sleeved onto the transmission sleeve, the inner thread section is screwed with the outer thread section.

13. The driving device of caulking gun of claim 4, wherein the housing has a rotation-preventing member, the rotation-preventing member has an insertion hole, the insertion hole has a flat section, the threaded rod is inserted through the insertion hole and has a recess section corresponding to the flat section.

* * * * *